US007712586B2

(12) United States Patent
Legez

(10) Patent No.: US 7,712,586 B2
(45) Date of Patent: May 11, 2010

(54) PASSENGER GUIDING SYSTEM FOR A PASSENGER TRANSPORTATION SYSTEM

(75) Inventor: Jacobus Benjamin Legez, DeKwakel (NL)

(73) Assignee: Otis Elevator Company, Farmington, CT (US)

( * ) Notice: Subject to any disclaimer, the term of this patent is extended or adjusted under 35 U.S.C. 154(b) by 706 days.

(21) Appl. No.: 11/569,370

(22) PCT Filed: May 26, 2004

(86) PCT No.: PCT/EP2004/005674

§ 371 (c)(1),
(2), (4) Date: Nov. 20, 2006

(87) PCT Pub. No.: WO2005/118452

PCT Pub. Date: Dec. 15, 2005

(65) Prior Publication Data

US 2007/0272493 A1 Nov. 29, 2007

(51) Int. Cl.
*B66B 1/34* (2006.01)

(52) U.S. Cl. ..... 187/391; 187/387; 187/392

(58) Field of Classification Search ..... 187/380–382, 187/385–387, 391, 392
See application file for complete search history.

(56) References Cited

U.S. PATENT DOCUMENTS

| | | | | | |
|---|---|---|---|---|---|
| 3,967,702 | A * | 7/1976 | Iwaska et al. | ..... | 187/387 |
| 3,973,649 | A * | 8/1976 | Iwasaka et al. | ..... | 187/387 |
| 5,276,295 | A * | 1/1994 | Kameli | ..... | 187/385 |
| 5,511,635 | A * | 4/1996 | Kameli | ..... | 187/392 |
| 5,544,059 | A * | 8/1996 | Hikita et al. | ..... | 701/117 |
| 5,679,932 | A * | 10/1997 | Kim | ..... | 187/382 |
| 6,257,373 | B1 * | 7/2001 | Hikita et al. | ..... | 187/392 |
| 2001/0035314 | A1 * | 11/2001 | Yoshida et al. | ..... | 187/382 |
| 2006/0037818 | A1 | 2/2006 | Deplazes et al. | | |
| 2009/0120727 | A1 * | 5/2009 | Hamaji et al. | ..... | 187/391 |

FOREIGN PATENT DOCUMENTS

| | | | | |
|---|---|---|---|---|
| EP | 0572926 | A1 | | 12/1993 |
| JP | 04106089 | | | 8/1990 |
| JP | 04358677 | A | * | 12/1992 |
| JP | 05116875 | | | 5/1993 |
| JP | 06144732 | A | * | 5/1994 |
| JP | 06179580 | A | * | 6/1994 |
| WO | WO01/64571 | A1 | | 9/2001 |
| WO | WO2004084556 | A1 | | 9/2004 |

OTHER PUBLICATIONS

International Search Report for International application No. PCT/EP2004/005674 mail Mar. 14, 2005.
Written Opinion of the International Searching Authority for International application No. PCT/EP2004/005674 mailed Mar. 14, 2005.

* cited by examiner

*Primary Examiner*—Walter Besnson
*Assistant Examiner*—Eduardo Colon-Santana
(74) *Attorney, Agent, or Firm*—Carlson, Gaskey & Olds PC

(57) ABSTRACT

Passenger transportation system (4) including a hallway (2) providing access to at least one transport car (6, 8, 10, 12) and a control for controlling the movement of the cars, characterized by a passenger trajectory tracking device (16) including a data processing means for monitoring the access areas to the cars (6, 8, 10, 12).

16 Claims, 3 Drawing Sheets

PASSENGER GUIDING SYSTEM FOR A PASSENGER TRANSPORTATION SYSTEM

BACKGROUND

The present invention relates to a passenger transportation system, for example an elevator system including a bank of elevators servicing a building, including a hallway providing access to at least one transport car and a control for controlling the movement of the car.

One of the main issues with such elevator systems is the control of the individual elevator cars so as to transport the passengers to the desired destination with a minimum waiting time in the hallway and with as few as possible intermediate stops before reaching the destination. Prolonged waiting time and an excess of intermediate stops are among the most dissatisfying conditions for the individual passenger. There are elevator systems which allow the passenger at the hallway not only to input his destination direction, i.e. upwards or downwards, but also the input of his precise destination, for example the input of the destination floor. Together with an indication to the passengers of the destination floors to be served by any car, i.e. "this car serves floors 23, 34, and 46", a control using such input information can be substantially improved as compared to a control which uses only the destination direction. However, particularly with heavy traffic such system has disadvantages insofar as the system has no control over the actual number of destination calls which have been served and which are still not served, etc. Thus, it is the object of the present invention to provide a passenger transportation system as specified above having an improved elevator control which receives more detailed information with respect to the respective passengers.

SUMMARY

In order to solve this problem, the passenger transportation system further includes a passenger trajectory checking device including a data processing means for monitoring the access areas to the cars. The passenger trajectory tracking device may include a sensor for sensing the position, speed and direction of passengers in the access areas to the cars and possibly also within the complete hallway. The data processing means can use such data for calculating the trajectory or the path on which the passenger has been moving and for calculating a predicted trajectory, if desired. The data processing means can be any type of microprocessor known to the skilled person for performing such calculation. The data processing means can be part of the control for controlling the movement of the cars so that the sensor or a plurality of sensors can be connected directly with the control of the passenger transportation system or alternatively, the data processing means can be associated to the sensor or the plurality of sensors for calculating the respective passenger trajectory data, and can be connected to the control of the passenger transportation system for transmitting such data thereto. For particular applications it might be advantageous to have a passenger trajectory tracking unit encompassing the data processing means as a "plug-in device" in order to allow easy retrofitting thereof to existing passenger transportation systems.

While it is possible to have a plurality of sensors connected to a single data processing means, it is also possible to have a plurality of passenger trajectory tracking devices each including a data processing means for monitoring the respective area. The individual passenger trajectory tracking devices can be coupled with each other and/or with the control of the passenger transportation system in order to allow the passenger tracking beyond the boundaries between the individual passenger trajectory tracking devices.

Such passenger trajectory tracking device opens a variety of options for improving the control of passenger transportation systems. Particularly, such system may notice that a huge number of passengers is heading towards a particular elevator car. This information can be used for assigning another car to the respective destination at an early stage before the respective car's overload sensor signals an overload condition. Such feature can redirect the passengers to another car and help to avoid unnecessary delays in car traveling caused by overload conditions.

It is to be noted that the present invention can be used in any type of passenger transportation system including any type of hallway or access area providing access to a plurality of transport cars like escalators and train systems. It is to be noted that beyond the optimization of the channeling of the passengers to the respective cars, the present system can also substantially enhance the safety of the passenger transportation system by comparing projected passenger trajectories with moving parts of the passenger transportation system, like incoming train, etc., and taking any action in case a potential collision is determined.

Preferably, the passenger trajectory tracking device includes an imaging device connectable to data processing means for determining the position, speed, and direction of passengers and objects and preferably of each passenger, and possibly also coarse information of the size of passengers, objects, etc. The imaging device can be a video camera, a thermal sensor, an infrared sensor or a radar system. Other devices like floor contact sensors, etc. may also be used. It is to be noted that the respective sensor system and particularly the respective imaging system can be rather simple with relatively low resolution and low refresh frequency. It is to be noted that modern low cost ship radar systems already provide ways to track objects, calculate their position, speed and course and calculate potential collision alerts. Such systems can track many moving objects at the same time. The respective hardware for sensors and microprocessor, etc. is relatively cheap and in addition to that hardware only calculation software is required. There will be no difficulty for the skilled person to implement the known solutions from the ship radar systems or from aircraft anti collision systems in a passenger trajectory tracking device for use in passenger transportation systems so that any detailed explanation of such technology will be omitted.

Preferably, the passenger transportation system further includes a means for providing information on the moving condition of the individual car doors and wherein the date processing means is further adapted to create potential collision alerts in order to react if the projected passenger trajectory and the projected car door trajectory are about to interfere with each other. Such reaction can be the issuance of a warning signal to the passenger or a command for reopening the car door, etc. The passenger trajectory tracking device can also be used to identify slow or handicapped persons heading towards a particular car and to delay the closing of the car door if appropriate. Additionally, the passenger trajectory tracking device can be implemented so as to allow the determination of the size of a person or a particular object moving in the access area or the hallway, for example a person pushing a trolley or a mother pushing a pram, a bed in hospital, etc. This information can be used for assigning a new car to the same destination even though the car which is already assigned to such destination is not yet overloaded in terms of weight.

Preferably, the passenger transportation system further comprises a destination input device placed in an area which is monitored by the passenger trajectory tracking device. Preferably, the destination input device is located centrally within an entrance area to the hallway. Obviously, a plurality of destination input devices can be provided even at a plurality of entrances. The destination input device can be any type of pushbutton destination input device, it can alternatively or additionally be an entrance identification device, for example a card reading device. In case of an identification system, person-related data stored in the elevator control can include the passenger's destination. This placement of the destination input device in an area which is monitored by the passenger trajectory tracking device allows to associate each passenger trajectory tracked by the passenger trajectory tracking device with his particular destination. Accordingly, the passenger transportation system does not only know where the passengers are moving, but also knows the destination of such passenger. Particularly, the passenger transportation system can use this information to check whether all passengers assigned to a particular car have entered the particular car. It can further use such information for monitoring as to whether or not the passenger is heading towards the correct car, etc. The passenger transportation system can also use this information for speeding up the dispatching of the car, for example closing the car door and dispatching the respective car once all passengers assigned to such car have entered the car. Particularly, the destination input device may input destination data to the data processing means so that the date processing means can link such destination data with the respective passenger trajectory. Particularly, the data processing means may calculate as whether or not a particular passenger is heading toward the correct car.

Preferably, the passenger transportation system comprises an indicator giving information to a particular passenger. Such an indicator may be a simple display associated with or adjacent to the destination input device informing the passenger of the particular car serving his destination. Additionally or alternatively, a similar display can be provided next to some or all of the cars informing for example of the destination floors to be served by such car. The indicator may further include any acoustic or optical device, for example a simple speaker system in the hall. Targeted indicators, i.e. indicating systems providing the optical or acoustic information directly to the particular passenger can also be provided. One such targeting indicating system can be a beamer or laser system projecting or beaming information in written form or in form of symbols on the floor in front of the respective passenger or to a wall within the direction of view of the respective passenger or at any place next to or in the sight of view of the passenger. Targeted acoustic systems which allow to "whisper within the passenger's ear" can also be used. As such targeted indicating systems preferably follow the passenger's trajectory, the passenger trajectory data can be used for controlling and targeting such systems. It is possible to use different, i.e. acoustic, optical, etc. indicators jointly.

Preferably, the destination input device is connected with the data processing means for inputting destination data to the data processing means and wherein the data processing means is adapted to calculate the number of passengers heading to a particular destination and wherein the control includes a second car dispatch device for calculating a potential overload condition on the basis of the actual load of the respective car assigned to the destination and number of passengers heading to such destination and for assigning a further car to the hallway which is assigned to said destination in case that a potential overload condition has been calculated. Thus, the passenger can be informed of the car to which he has been assigned immediately after the destination input device has received information on his destination allowing guidance of the passenger to the correct car already at an early stage of his path towards the car. The second car dispatch device may also obtain information on the number of passenger trajectories heading towards the car in order to take into account passengers who missed to input their destination, since particularly in a heave traffic situation not every passenger will input his destination. This feature allows the calculation of the potential overload condition on the basis of the destination input device data and/or passenger trajectory data and/or the actual load data as provided by the passenger transportation system.

The present invention also relates to a method for controlling the access to a passenger transportation system including a hallway providing access to at least one transport car and a control for controlling the movement of the car characterized by (a) monitoring the access areas to the car by way of a passenger trajectory tracking device;
(b) determining the position, speed an direction of the passenger's access areas;
(c) controlling the passenger transportation system on the basis of such passenger trajectory data; and/or
(d) providing information to the passenger on the basis of such passenger trajectory data.

Accordingly, it is possible to assign a further car to the hallway which is assigned to the same destination if a particular car which is likely to be overloaded. It is also possible to send a signal for closing the car door and dispatching the car in case that the last passenger heading towards such car slows down and turns away from the respective car or alternatively reopening the car door in case that a passenger is hurrying towards such car in case that overload condition of the car had not yet been reached. It is also possible to delay the closing of the car door in case that a passenger, particularly a slow or handicapped passenger, is heading towards the particular car. Alternatively, it is possible to inform a passenger if he is heading towards an incorrect car or of the fact that he cannot ride with the car he is heading to due to the fact that such car is close to an overload condition, etc.

Preferably, the method includes the further steps of determining the car towards which the passenger is heading; calculating an estimated time for arrival at the car; determining the load condition of such car; and delaying the closing of the car door until the estimated time of arrival of the passenger or until the passenger has entered the car provided the car is not yet full. These steps avoid the frustrating and dissatisfying closing of cat doors just in front of a passenger heading towards such car. Particularly, this avoids or reduces actions with the potential for infringing the passenger, for example protruding legs or arms in the way of the closing car doors.

Preferably, the method includes the further steps of providing information on the moving condition of the car door; comparing the passenger trajectory data and the car door moving condition data and assessing as to whether the passenger is on a collision course with the closing door; and issuing a door reversal signal to the door control provided the car is not yet full or informing the passenger of the fact that the car is already full. A car door movement sensor can be provided for providing the information on the moving condition of the car door. Alternatively, the car door moving profile can be stored for example in the data processing means so that information on the starting time of the car door movement is sufficient for calculating the moving condition of the car door. Similarly a usual car load sensor or any similar means providing data on the car load condition which are known to the person skilled in the art can be used for providing the information on the car load condition.

Preferably, the method includes the further steps of determining an alternatively available car for the passenger and informing the passenger of the alternatively available car. This step may include the step of assigning a further car to the particular destination. The information can either be given to the passenger by way of any type of monitor or display located adjacent to the overloaded car or by way of a targeted indicator as discussed above. Such early redirecting of the passengers avoids any delays caused by overload conditions and avoids dissatisfaction of the passenger due to the fact that he will be informed of an alternatively available car at the same time when realizing that the particular car he is heading to is overloaded.

On the other hand, in many cases passengers do not enter a relatively full car, which nevertheless has the capacity of transporting such additional passenger. The passenger heading towards such full car slows down when realizing the load condition of the car and either stops or turns to another car. If the passenger trajectory tracking device notices such behavior, particularly in case there is no other passenger heading towards this car, the data processing means may issue a signal to the elevator control to immediately close the door and dispatch the car to its designation. Also in this case it is advisable to inform the respective passenger who did not enter the car of an alternatively available car serving his destination.

Preferably, the method includes the further steps of obtaining passenger destination data from a destination input device; correlating such destination data with the respective passenger; assigning a particular car to such destination; and informing the respective passenger of the assigned car. The system may then follow the passenger's movement until he enters the car and once all the passengers assigned to a particular car have entered such car, the data processing means may issue a signal for immediately closing the respective car doors and dispatching the car to its destination.

Preferably, the method may include the further steps of determining the car which the respective passenger is heading for, and informing the respective passenger if he is heading for a wrong car. By doing so, the passenger transportation system can reliably channel the passengers to the correct car and can improve a fast and smooth dealing with the traffic load by reducing the interruptions and delays caused by passenger entering wrong cars and pressing destination buttons in the car which are not consistent with the destinations as assigned to such particular car.

Preferably, the method includes the further step of calculating the number of passengers heading to a particular destination; calculating a potential overload condition of the assigned car on the basis of the assigned car on the basis of the actual load of the assigned car; assigning a further car to such destination if there is a risk of an overload condition; and informing at least one passenger of the further car assigned to such destination. The step of calculating a potential overload condition of the assigned car may include the step of determining the number of passengers heading to the respective car on the basis of the passenger trajectory data.

Preferably, the method includes the further steps of tracking the individual waiting times of passengers and storing such individual waiting times or calculating performance data of the passenger transportation system based on such individual waiting time. Such data may either be used for optimizing the traffic/car allocation or could also be used for customer reports.

It is to be noted that the present invention results not only in measurable improvements in assignment speed and transportation speed and safety, but also in a more "human behavior" of the passenger transportation system towards the passengers.

BRIEF DESCRIPTION OF THE DRAWINGS

The invention and embodiments of the invention will subsequently be described by way of example only with respect to the attached drawings in which.

DETAILED DESCRIPTION

Figure 1:
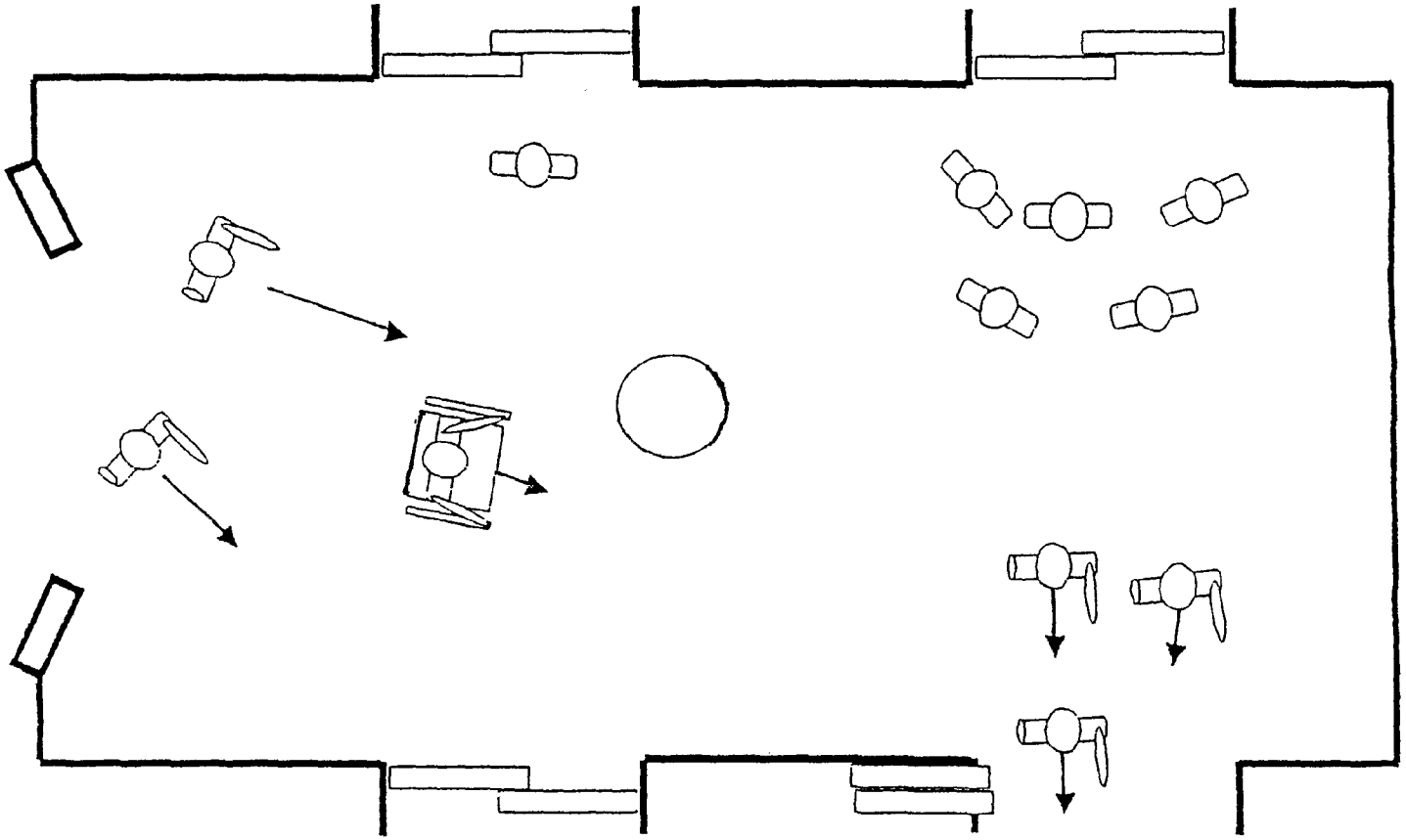
FIG. 1 is a plan view on the hallway of a passenger transportation system according to the present invention.

FIG. 1 shows a plan view on a hallway 2 of a passenger transportation system 4 according to the present invention. The hallway 2 provides access to a plurality of transport cars 6, 8, 10, and 12. Transport cars 6, 8, 10, 12 are driven by a drive unit (not shown) and can move under guidance of a control (not shown). The control can assign the cars to particular destinations and can dispatch the cars to the destinations or alternatively dispatch cars to the hallway for being available then for assignment and dispatching. Also the control may include the typical safety control features like safety chain, etc. ensuring secure shutdown in case of an emergency. There may be one control for every single transport car 6, 8, 10, 12, one control for a group of transport cars or a single control for all the transport cars 6, 8, 10, 12 in the respective passenger transportation system. The individual controls can preferably be interconnected with each other.

Doors 14 are provided for closing the entrance to each transport car. Additionally to the hallway doors 14 separate doors can be provided for each transport car. The movement of the doors 14 and any car doors can also be controlled by way of the control.

While the present embodiment as shown in FIG. 1 is having 4 transport cars, the present invention can be used in connection with any number of transport cars.

Moreover, the hallway 2 does not necessarily have to be the main entrance level to a building, but the present invention can be implemented in any hallway 2 at any level of the building. While some advantages of the present invention, like increasing the efficiency of the transportation system, can most advantageously be obtained at levels having high traffic, other advantages such as avoiding door collisions can be obtained at a level independent of the traffic.

The passenger transportation system 4 according to the present invention includes a passenger trajectory tracking device 16 including a data processing means (not shown) for monitoring the access areas to the cars.

The passenger trajectory tracking device 16 can include one or more sensors, for example imaging sensors, like simple camera, thermal sensor or rotating radar, useful for sensing the position, speed, and direction of a passenger or any other object which is moving within its sight of view. Each sensor can be connected with an individual data processing means, alternatively, a group of sensors or all sensors can be connected with one data processing means. The data processing means can be positioned together with the particular sensor, but can alternatively be located remote therefrom, for example adjacent to the control of the passenger transportation system or can even be integrated therewith. Particularly in case of an elevator system a single sensor can be located at the ceiling, preferably centrally within the hallway, alternatively, multiple sensors can be distributed within the hallway. It is possible to locate the sensors in the corners of the hallway. Multiple sensors are particularly preferred in connection with intricate hallways where a plurality of sensors are required to monitor the hallway completely.

While for particular safety and courtesy features like door closing delay and avoiding of door collision monitoring of a limited access area in front of each car door is required, a virtually complete monitoring of the hallway is required in order to ensure optimum passenger guidance in the hallway.

In the embodiment of FIG. 1 a destination input device 18 is located at the entrance 20 of the hallway 2. Additionally or alternatively, destination input devices can be positioned elsewhere, for example next to the entrance of a car, etc. The destination input device can comprise a pushbutton field for entering the number of the destination floor. the destination input device is preferably connected to the control of the passenger transportation system.

Figure 2:
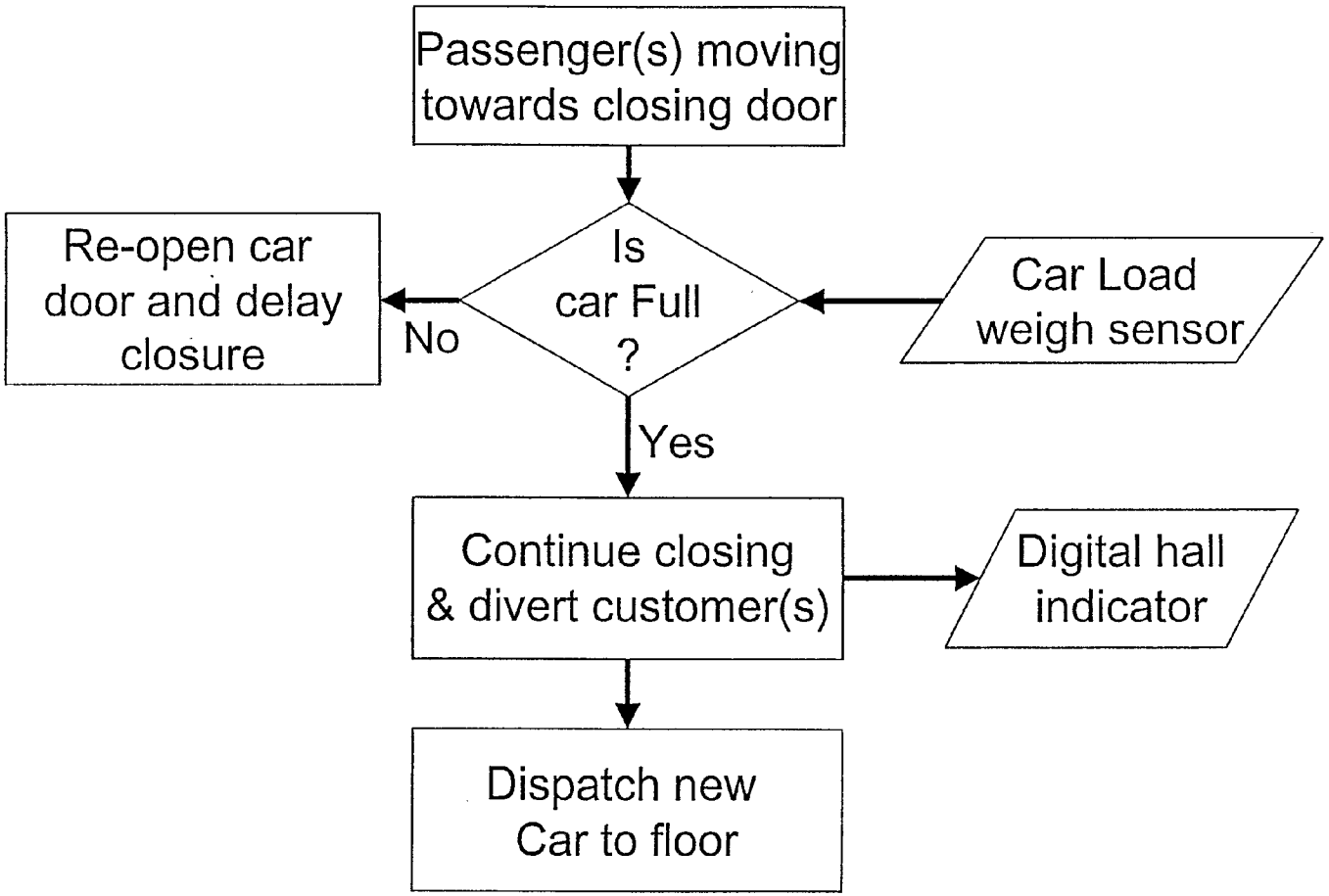
FIG. 2 is a flow chart of a passenger guiding operational mode of a passenger transportation system according to the present invention.

FIG. 2 is a flow chart detailing a possible way for channeling the passengers entering the entrance 20 to hallway 2 towards the correct car.

In step 22 the passenger enters the destination floor in the destination input device 18. At this point, the passenger trajectory tracking device 16 can identify the passenger and correlate the destination floor with the respective tracked person. This correlation can either be done in the data processing means of the passenger trajectory tracking device 16 or in the control of the passenger transportation system. At this step 22 the passenger is assigned to one of the transport cars which is either already assigned to the destination floor or has been reassigned in consequence of the destination input. Next step 24 is to inform the passenger which car to use. For example this is done by way of a digital hall indicator 26. There may also be an indicator position together with the destination input device 18. Alternatively or additionally indicators (not shown) can be provided next to the respective car. The digital hall indicator can be any type of indicator reaching the passenger anywhere in the hallway.

Subsequently the passenger trajectory tracking device 16 follows the the passengers path and decides in step 28 as to whether or not the passenger walks to the correct car.

The decision as to whether or not the passenger walks to the correct car, i.e., the car which he has been assigned, can be made on the basis of different criteria. For example, the passenger transportation system may calculate an optimum path towards the respective car and follow as to whether or not the passenger is following the correct path. Advantageously the calculation of the optimum path takes into account any passengers or objects in his way, particularly by recalculating the optimum path frequently. Once the passenger deviates from such optimum path to a certain degree, the passenger transportation system may decide that the passenger is not walking towards the correct car. In order to avoid false indications to the passenger, additional criteria can be applied, for example that such an indication is only to be given if the passenger is within a previously determined distance to the door of a wrong car, or if the passenger stops and waits in front of a closed door of a wrong car.

Alternatively, the decision as to whether or not the passenger walks to the correct car is made on the basis of the passenger's trajectory without calculating an optimum path in advance. With such method, it can be decided that the passenger is walking towards the correct car if the passenger's path is pointing towards the correct car or not. In this case the angular deviations which can be allowed can be dependent on the distance from the passenger to the door of the correct car so that the closer the passenger approaches the correct car, the less angular deviations are allowable. Basically, the person skilled in the art will be able to select particular criteria for deciding as to whether or not the person is walking to the correct car. Provided that the passenger is walking towards the correct car, no change will apply in step 30 and the system moves on to step 32 where a check is made as to whether or not the passenger has entered the car. For example such check can be made by step 27 wherein the passenger trajectory tracking device 16 calculates the passenger's position, speed and direction. Once the passenger has left the hallway and entered the car, this is a clear indication to the passenger transportation system 4 that the car has been entered. Alternatively or additionally, the car load measuring system (not shown) can register the entrance of an additional passenger into the car and provide this information to the passenger transportation system to either inform it of the fact that the passenger has entered the car or to confirm the data as received by the passenger to check the tracking device 16. If the passenger has entered the car, the system goes on to step 34. In this step the passenger transportation system closes the operation of guiding this particular passenger and cancels any indication as made to the passenger, for example any indication that he is heading towards an incorrect car. If necessary, the system 4 will cancel any orders to the digital hall indicator 36.

If in step 28 the system 4 notices that the passenger is walking to an incorrect car, the system 4 will go on to step 38 generating an order to the digital hall indicator in step 40 to inform the passenger of his mistake. Again, in step 28 the system 4 will decide on the basis of the passenger's speed an direction obtained from step 27 as to whether or not the passenger is walking to the correct car. From step 28 the system 4 will either continue with step 30 or step 38 as described above or continue to inform the passenger whether he is heading towards an incorrect car.

If the passenger enters an incorrect car in step 32 despite the indication, the system 4 goes back to box 34 and terminates the guiding of the passenger in the hallway 2 as explained before.

If in step 32 the system 4 notices that passenger has not entered any car, the system will continue to inform the passenger of the correct car by way of the digital hall indicator in steps 34 and 40.

Thus it can be seen that in accordance with the floor chart logic of FIG. 2 the passenger is guided from the destination input device 18 to the respective car 6, 8, 10, 12. The guidance terminates once the passenger has entered a car, independently of whether or not the passenger has entered the correct car.

The passenger trajectory tracking device 16 may also track the passenger's path in advance of entering the entrance 20 to the hallway 2 and obtain information on the speed of the passenger in advance of assigning the passenger to a car on the basis of the information received from the destination input device. Thus the passenger's moving speed can already be taken into account when assigning the passenger to a particular car. In case the passenger is approaching the destination input device very fast, the passenger can be assigned to a car which services the particular destination floor and which would normally leave the hallway 2 before the passenger reaches the respective car, taking into account a slight delay of the car's departure time. If on the other hand a very slow person is approaching the destination input device, the respective assignment can be made taking into account the person's slowness and assign such person to an alternative car servicing such destination floor in order to avoid undue delay of the departure time of the car which is in the course of servicing this destination floor.

A guidance or channeling of the passengers to the particular cars can also be enhanced by way of the passenger trajectory tracking device due to the fact that the passenger trajectory tracking device can at least to a certain degree give information on the size of a particular object moving within its side of field. Thus the passenger trajectory tracking device can identify a wheelchair, a bed in a hospital, a mother pushing a pram and possible also two or more persons belonging together as a group once they follow the same trajectory or move on parallel trajectories with a relatively small distance from each other, and particularly if they gather in front of a destination input device or at any other place. This will give the passenger transportation system the chance to assign such bigger object or to such group to another car even though the car which has already been assigned to the respective destination floor is not yet full.

It can be advantageous if the passenger trajectory tracking device 16 does not only monitor the hallway 2 but also monitors a particular area around the entrance 20 to the hallway 2 where the passenger approaches the destination input device 18.

The passenger trajectory tracking device 16 needs only to "see" the position, the speed and the direction and possibly also the size of "crude shapes". Therefore inexpensive sensors and a small number of sensors can be used. For example it is possible to use 360° lenses, i.e. fish—eye lenses or rotating short rage radar. The sensor's and/or data processing means' sensitivity can be calibrated through a learning function implemented within the data processing means or the control in order to optimize the system's functionality. This optimization can include the size of the object's registered and followed by the passenger trajectory checking device 16, the dealing with very fast and very slow persons, the load condition of the car, which is acceptable to the passenger on average and which might be substantially less than the actual overload condition, the criteria for deciding on a person heading for an incorrect car, etc.

Figure 3:
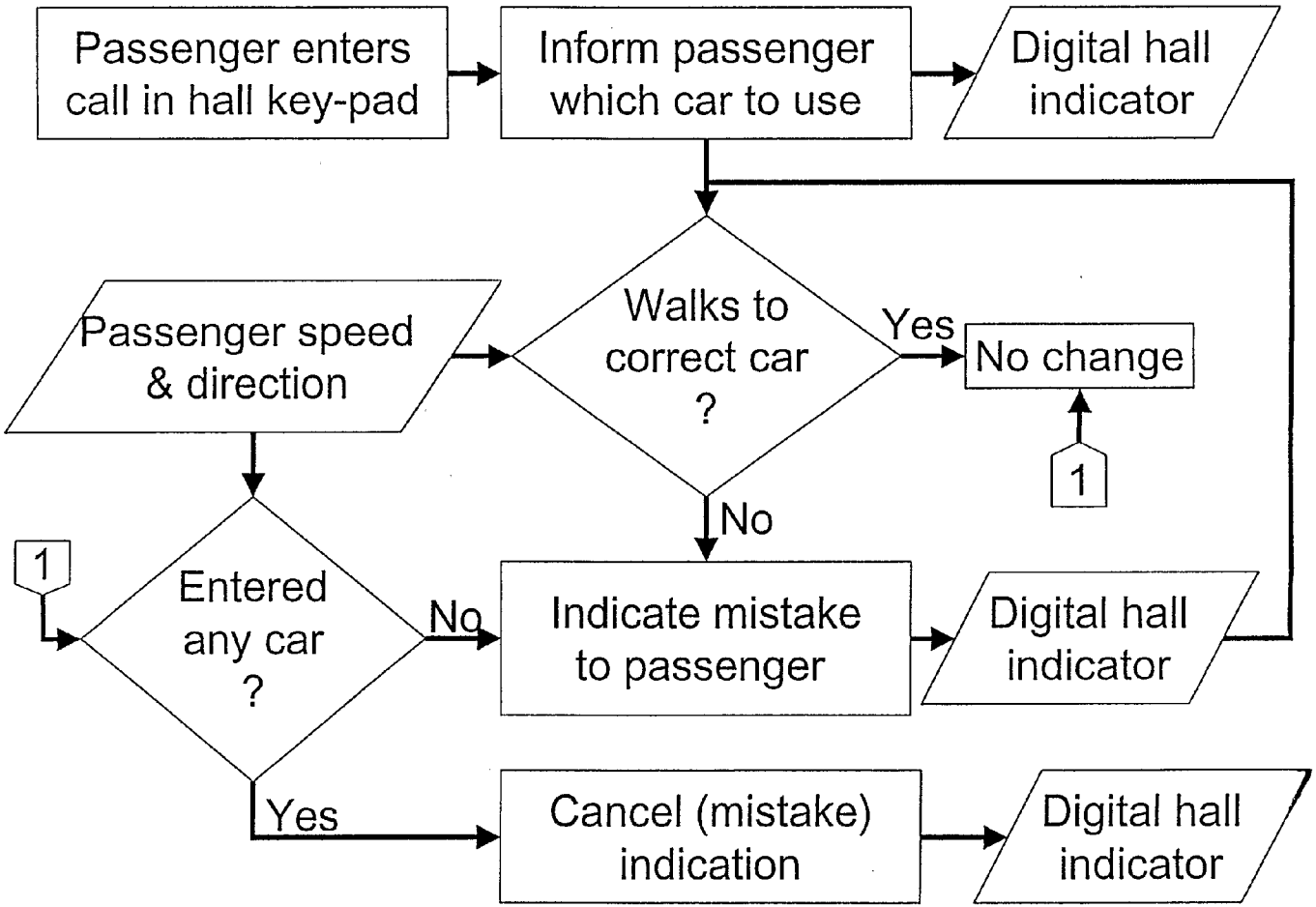
FIG. 3 is a flow chart detailing the control logic for a door collision obviating operational mode of the passenger transportation system of the present invention.

In FIG. 3 another flow chart is shown detailing the steps to be made by the system 4 in case a passenger or a plurality of passengers is moving towards a closing door. In step 42 the passenger trajectory tracking device 16 identifies that a passenger is moving towards the door 14 of a car. The system 4 further receives information on the closing condition of the respective car door 14. If the system 4 notices that the car door 14 to which the passenger is moving is about to close, the system will go to step 44 where it will decide for example on the basis of the input of the car load weight sensor 46 as to whether or not the car is full or not. If not, the system 4 will go to step 48 and will reopen the car door 14 or will delay the closure of the car door 14 and will start again to close the car door 14 only when the passenger has entered the car. If in step 44 the car is already full, the system continues in step 50 to close the door 14 and assigns a new car to service the respective destination in step 52. Additionally the system diverts the passenger in step 50 to this newly dispatched car by way of giving the respective order to the digital hall indicator 26. The system may then continue at step 28 of the flow chart of FIG. 2.

As has been disclosed above, the passenger trajectory tracking device 16 of the present invention can provide a number of advantageous functions to the passenger transportation system 4 and particularly to an elevator system as such:

time for reversal in case the passenger is on a collision course with a closing door;

car door closure delay in case a passenger, particularly a disabled or slow passenger, moves to a car that is about to close, but not yet full;

second car dispatch or second car assignment, i.e. in case too many passengers are lined up for a certain car and overload is anticipated, a second car can already be dispatched.

This is a probable scenario since in case of heavy traffic not everybody will push the destination floor, but will enter the hallway and look for the right car.

Thus the system can trace the number of passengers heading for a particular destination and assign or dispatch a new car with the same destination.

It can be a support for a guiding system particularly with low traffic, whereby entering passengers could be channeled and guided, for example through a laser-projected symbol on the floor or wall, to the right car. It is to be noted that this system could be truly interactive and warn a passenger who is moving in the wrong direction.

Detection of "special passengers" like wheelchairs, luggage or trolley at airports and train stations or beds in a hospital. Since all these passengers and objects have distinguishable shapes and speed, the system can react and for example with a bed in a hospital, re-direct other passengers and prioritize car with delayed operations. The latter would prevent the need for "manual" prioritizing through codes, card readers, etc.

Performance tracking is also possible, since it would be possible to track individual waiting time. This information could be used to optimize the traffic and car allocation or car assignment. It could also be used for customer reports both consolidated as for an individual person, which can be shown display upon leaving the car.

The invention claimed is:

1. A method for controlling access to a passenger transportation system including a hallway providing an access area to access at least one transport car and a control for controlling movement of the car, comprising the steps of (a) monitoring the access area to the car;

(b) obtaining passenger destination data from a destination input device;

(c) determining passenger trajectory data including position, speed and direction of passengers in the access area;

(d) controlling the passenger transportation system on the basis of the passenger trajectory data; and (e) providing information to at least one passenger on the basis of the passenger trajectory data.

2. The method according to claim 1, including determining a car to which at least one passenger is heading;

calculating an estimated arrival time of the at least one passenger at the car;

determining the load condition of the car; and delaying the closing of a door of the car until the estimated arrival time of the passenger, provided that the car is not yet full.

3. The method according to claim 1, including providing information on a moving condition of the car door;

comparing the passenger trajectory data and the car door moving condition information;

determining whether the passenger is on a collision course with the car door; and issuing a door reversal signal, provided that the car is not yet full.

4. The method according to claim 1, including providing information on a moving condition of the car door;

comparing the passenger trajectory data and the car door moving information;

determining whether the passenger is on a collision course with the door; and informing the passenger, provided that the car is already full.

5. The method according to claim 4, including determining an alternatively available car for the passenger and informing the passenger of the alternatively available car.

6. The method according to claim 1, including obtaining passenger destination data from a destination input device;

correlating passenger destination data with the respective passenger;

assigning a particular car to a corresponding destination; and informing the respective passenger of the assigned car.

7. The method according to claim 6, including determining the car to which the respective passenger is heading; and informing the respective passenger if he is heading for a wrong car.

8. The method according to claim 6, including determining a number of passengers heading for a particular destination;

determining a potential overload condition of a correspondingly assigned car on the basis of the actual load of the assigned car;

assigning a further car to the particular destination; and informing at least one of the passengers of the further car assigned to such destination.

9. The method according to claim 1, including tracking individual waiting times of passengers; and storing the individual waiting times.

10. A passenger transportation system including a control for controlling the movement of at least one transport car;

a passenger trajectory tracking device configured to monitor an access area to access the at least one transport car, the passenger trajectory tracking device includes an imaging device connected with a data processor configured to determine a position, speed and direction of each passenger; and a destination input device placed in access area which is monitored by the passenger trajectory tracking device.

11. The passenger transportation system of claim 10, wherein the destination input device provides an indication to the transportation system, the indication indicating a destination floor selected by a passenger prior to the passenger entering the at least one transport car.

12. The passenger transportation system according to claim 10, including a means for providing information regarding a moving condition of individual ear doors and wherein the passenger trajectory tracking device is configured to create potential collision alerts.

13. The passenger transportation system according to claim 10, comprising an indicator giving indications to a particular passenger.

14. The passenger transportation system according to claim 10, wherein the destination input device is connected wit a data processor of the passenger trajectory tracking device for inputting destination data to the data processor wherein the data processor is configured to calculate the number of passengers heading for a particular destination, and wherein the control includes a second car dispatch device for calculating a potential overload condition on the basis of the actual load of the respective car assigned to said destination and the number of passengers heading for said destination and for assigning a Thither car to the hallway assigned to said destination.

15. A passenger transportation system including a control for controlling the movement of at least one transport car;

a passenger trajectory tracking device configured to monitor an access area to access the at least one transport car; and a destination input device placed in the access area which is monitored by the passenger trajectory tracking device, the destination input device is connected with a data processor of the passenger trajectory tracking device for inputting destination data to the data processor wherein the data processor is configured to calculate the number of passengers heading for a particular destination, and wherein the control includes a second car dispatch device for calculating a potential overload condition on the basis of the actual load of the respective car assigned to said destination and the number of passengers heading for said destination and for assigning a further car to the hallway assigned to said destination.

16. The passenger transportation system according to claim 15, wherein the passenger trajectory tracking device includes an imaging device connected with a data processor configured to determine a position, speed and direction of each passenger.

* * * * *

UNITED STATES PATENT AND TRADEMARK OFFICE

CERTIFICATE OF CORRECTION

PATENT NO. : 7,712,586 B2
APPLICATION NO. : 11/569370
DATED : May 11, 2010
INVENTOR(S) : Jacobus Benjamin Legez It is certified that error appears in the above-identified patent and that said Letters Patent is hereby corrected as shown below:

IN THE CLAIMS:

Claim 14, Column 12, line 18: please delete "wit" and replace with --with--

Claim 14, Column 12, line 26: please delete "Thither" and replace with --further--

Signed and Sealed this

Twenty-seventh Day of July, 2010

David J. Kappos

David J. Kappos
*Director of the United States Patent and Trademark Office*